US008373565B2

(12) United States Patent
Yang

(10) Patent No.: US 8,373,565 B2
(45) Date of Patent: Feb. 12, 2013

(54) SECURITY APPARATUS WITH CONDUCTIVE RIBBONS

(76) Inventor: Xiao Hui Yang, Los Altos, CA (US)

( * ) Notice: Subject to any disclaimer, the term of this patent is extended or adjusted under 35 U.S.C. 154(b) by 16 days.

(21) Appl. No.: 13/177,447

(22) Filed: Jul. 6, 2011

(65) Prior Publication Data

US 2011/0260594 A1 Oct. 27, 2011

Related U.S. Application Data

(63) Continuation-in-part of application No. 13/151,106, filed on Jun. 1, 2011, which is a continuation-in-part of application No. 12/815,380, filed on Jun. 14, 2010, and a continuation-in-part of application No. 13/010,571, filed on Jan. 20, 2011, which is a (Continued)

(51) Int. Cl.
*G08B 13/14* (2006.01)

(52) U.S. Cl. ..... 340/572.8; 340/572.1; 340/10.1

(58) Field of Classification Search ..... 340/572.1, 340/10.1, 505

See application file for complete search history.

(56) References Cited

U.S. PATENT DOCUMENTS 4,086,795 A 5/1978 Foster
4,620,182 A 10/1986 Keifer
4,756,171 A 7/1988 Homar
4,776,188 A 10/1988 Dalaba
4,893,853 A 1/1990 Guiler
4,896,517 A 1/1990 Ling
4,962,369 A 10/1990 Close
5,156,028 A 10/1992 Jiang
5,337,459 A 8/1994 Hogan
5,565,848 A 10/1996 Leyden
5,570,080 A 10/1996 Inoue
5,722,266 A 3/1998 Yeager
5,764,147 A 6/1998 Sasagawa
5,767,773 A 6/1998 Fujiuchi
5,786,759 A 7/1998 Ling
5,794,464 A 8/1998 Yeager
5,856,782 A 1/1999 Sasagawa
5,959,532 A 9/1999 Fujiuchi
6,020,819 A 2/2000 Fujiuchi
6,092,401 A 7/2000 Sankey
6,140,923 A 10/2000 Lam
6,177,869 B1 1/2001 McDaid
6,237,375 B1 * 5/2001 Wymer ..... 70/14
6,420,971 B1 7/2002 Leck
6,550,293 B1 4/2003 Delegato
6,624,753 B2 9/2003 Elston
6,731,212 B2 5/2004 Hirose
6,755,055 B2 6/2004 Sedon (Continued)

*Primary Examiner* — Travis Hunnings
(74) *Attorney, Agent, or Firm* — Waters Law Group, PLLC; Robert R. Waters; Brian W. Foxworthy

(57) ABSTRACT

An electronic article surveillance (EAS) security apparatus is comprised of a housing, base plate, ribbon pad, and electrically conductive ribbons. In one embodiment, the ribbons pre-attached to the ribbon pad and extend from the ribbon pad. The ribbon pad and base plate on installed on opposite sides of an object to be protected. The ribbons are extended around the object and their extended ends attached to the base plate. The housing has electrical contacts and encloses electronics and is attached to the base plate so that the electrical contacts complete circuits through the ribbons. The electronics in the housing monitor the ribbons to detect unauthorized removal of the apparatus. A switch on the bottom of the housing detects that the housing is attached to a plate and object. The apparatus has a locking mechanism to maintain the housing and plate together, which can be released by application of a magnet.

14 Claims, 10 Drawing Sheets

Related U.S. Application Data continuation-in-part of application No. 12/726,879, filed on Mar. 18, 2010, which is a continuation-in-part of application No. 12/498,367, filed on Jul. 7, 2009, now Pat. No. 8,274,391, which is a continuation-in-part of application No. 12/391,222, filed on Feb. 23, 2009, now Pat. No. 8,144,014.

(60) Provisional application No. 61/186,889, filed on Jun. 14, 2009, provisional application No. 61/030,932, filed on Feb. 22, 2008, provisional application No. 61/303,929, filed on Feb. 22, 2008.

(56) References Cited

U.S. PATENT DOCUMENTS

| | | | | |
|---|---|---|---|---|
| 7,162,899 | B2 | 1/2007 | Fawcett | |
| 7,168,275 | B2 | 1/2007 | Fawcett | |
| 7,227,467 | B2 | 6/2007 | Feibelman | |
| 7,239,238 | B2 | 7/2007 | Tester | |
| 7,251,966 | B2 | 8/2007 | Fawcett | |
| 7,350,381 | B2 | 4/2008 | Fawcett | |
| 7,400,254 | B2 * | 7/2008 | Yang et al. | 340/572.1 |
| 7,403,118 | B2 | 7/2008 | Belden, Jr. | |
| 7,474,209 | B2 | 1/2009 | Marsilio | |
| 7,474,222 | B2 * | 1/2009 | Yang et al. | 340/572.8 |
| 7,481,086 | B2 | 1/2009 | Fawcett | |
| 7,497,100 | B2 | 3/2009 | Fawcett | |
| 7,497,101 | B2 * | 3/2009 | Fawcett et al. | 70/57 |
| 7,522,048 | B2 | 4/2009 | Belden, Jr. | |
| D599,693 | S | 9/2009 | Sayegh | |
| 7,659,817 | B2 | 2/2010 | Conti | |
| 7,685,850 | B2 | 3/2010 | Nilsson | |
| D628,923 | S | 12/2010 | Sayegh | |
| D628,924 | S | 12/2010 | Sayegh | |
| 7,918,112 | B2 | 4/2011 | Fawcett | |
| 8,144,014 | B1 * | 3/2012 | Yang | 340/572.1 |
| 2006/0220848 | A1 | 10/2006 | Tropper | |
| 2006/0250241 | A1 * | 11/2006 | Renzetti et al. | 340/572.1 |
| 2009/0212920 | A1 | 8/2009 | Yang | |
| 2009/0289798 | A1 * | 11/2009 | Yang | 340/572.8 |
| 2010/0171621 | A1 * | 7/2010 | Yang | 340/572.9 |
| 2010/0188227 | A1 | 7/2010 | Yang | |
| 2010/0214102 | A1 * | 8/2010 | Yang | 340/572.9 |
| 2010/0315237 | A1 | 12/2010 | Yang | |
| 2010/0315239 | A1 * | 12/2010 | Yang | 340/572.9 |
| 2011/0115632 | A1 * | 5/2011 | Yang | 340/572.8 |
| 2011/0121973 | A1 * | 5/2011 | Yang | 340/572.8 |
| 2011/0227706 | A1 * | 9/2011 | Yang | 340/10.1 |

* cited by examiner

SECURITY APPARATUS WITH CONDUCTIVE RIBBONS

CROSS REFERENCE TO RELATED APPLICATIONS

This application is a continuation-in-part of U.S. application Ser. No. 13/151,106, which in turn is a continuation-in-part of U.S. patent application Ser. No. 12/815,380 filed on Jun. 14, 2010, (now U.S. Pat. No. 8,334,776), and U.S. patent application Ser. No. 13/010,571 filed on Jan. 20, 2011. U.S. patent application Ser. No. 12/815,380 (now U.S. Pat. No. 8,334,776) in turn claims priority to U.S. Provisional Application 61/186,889 filed on Jun. 14, 2009. U.S. patent application Ser. No. 13/010,571 is a continuation-in-part application based on U.S. patent application Ser. No. 12/726,879 filed on Mar. 18, 2010(now U.S. Pat. No. 8,305,219). U.S. patent application Ser. No. 12/726,879 (now U.S. Pat. No. 8,305,219) is a continuation-in-part application based on U.S. patent application Ser. No. 12/498,367, filed on Jul. 7, 2009 (now U.S. Pat. No. 8,274,391). U.S. patent application Ser. No. 12/498,367 is a continuation-in-part application based on U.S. patent application Ser. No. 12/391,222 filed on Feb. 23, 2009 (now U.S. Pat. No. 8,144,014), in turn claiming priority to U.S. Provisional Application 61/030,932, filed on Feb. 22, 2008, and U.S. Provisional Application 61/030,929 filed on Feb. 22, 2008. The entire disclosures contained in U.S. patent application Ser. Nos. 12/815,380, 13/010,571, 12/726,879, 12/498,367, and 12/391,222, U.S. Pat. No. 8,334,776, U.S. Pat. No. 8,305,219, U.S. Pat. No. 8,274,391, and U.S. Provisional Applications 61/186,889, 61/030,932, and 61/030,929, including the attachments thereto, are incorporated herein by reference.

FIELD OF THE INVENTION

This application relates to the field of electronic article surveillance (EAS) and security. In particular, this application relates to EAS systems that wrap elements around an object to be protected and monitor the elements with electronics in associated housings.

BACKGROUND OF THE INVENTION

Electronic article surveillance systems have been used for many years as a means of deterring retail shoplifting in clothing stores, electronic stores, and a myriad of other retail establishments. Generally speaking, an EAS system will begin with a tag, consisting of a durable and reliable, yet small, sensor tag which is affixed to the article to be detected in such a way that it cannot be easily removed by a customer in the store. Usually, the system depends upon the feature that the attachment mechanism is constructed such that it can only be removed by the use of a specialized tool which is only in the possession of the store personnel at the checkout register or exit port for the establishment. In the event that an EAS tag is not removed from a protected article prior to exiting the store, an alarm or other signal is activated.

In many commercially available EAS systems, one or more antennas are placed at the exits and entrances to the retail location. These antennas set up zones, sometimes referred to as interrogation zones, in which an EAS tag (or marker) may be sensed. At least one antenna serves the function of sending out what is called an interrogation signal. The markers on the merchandise are affected by this signal and will respond with a signal of their own. Either the same antenna that sends out the interrogation signal or other additional antennas can sense the signals from the markers. The most effective way to do this is by stopping the broadcast of the interrogation signal to listen for the signals emanating from the markers. If a marker is sensed within the zone created by the antennas, it is presumed that an article is being removed without purchase, and alarms are set off. These alarms may be audible alarms for general broadcast or the alarms may be silent alarms in the form of a light at a check-out counter or security station, etc.

In the earliest EAS systems passive EAS elements were used in the EAS tags. In systems using passive elements, an interrogation field is created at control locations, such as exits, by transmitting antennas. The transmitting antennas intermittently create a field in their near surroundings. This field and the passive EAS element are tuned to each other. If an EAS tag having a passive element enters an interrogation field, the field energizes the passive element which allows the passive element to produce a signal. The passive element may be of a type that produces a signal that is a harmonic of the interrogation field or a signal that resonates with the interrogation field.

More recently developed EAS systems employ wireless communication with the EAS tags. The electronics onboard the EAS tags are more sophisticated. Some systems may employ radio frequency communication as the wireless communication, while others may employ optical communication, such as infrared communication. Some may employ both radio frequency and optical communication. Also, EAS systems employing wireless communication may also employ passive elements in the tags as well.

In order to make an EAS system effective, one must consider how to make the EAS tags tamper resistant. This is an on-going effort, because over time, thieves become more clever in learning how to tamper with an EAS tag to defeat it. The retailer (and the tag manufacturer) must consider how to detect and prevent tampering with the tags. The particular construction of a tag will determine how tampering is detected.

RELATED ART

U.S. Pat. No. 7,474,209 by Marsilio et. al is for a "Cable Alarm Security Device." A security device for attachment to an article to deter theft of the article has a housing containing an alarm system including an audible alarm and an LED. A cable has one end attached to the housing and a second end attached to a plug which is selectively inserted into and locked to the housing. The cable includes a conductor electrically connected to the alarm system when in the locked position. The audible alarm is activated if the integrity of the cable is compromised. An EAS tag located in the housing will actuate an alarm at a security gate and can actuate the audible alarm of the security device when the device is in proximity to a security gate. The LED is positioned in the housing to be visible from both sides of the housing. A magnetically attractable lock mechanism releasably secures the cable plug in the locked position.

U.S. Pat. No. 5,722,266 by Yeager et al. is for a "Universal Wrap Security Device." A security device includes a locking member, a ratchet member, and a plurality of cables. The cables extend through both a fastener and a base of the locking member and are wrapped around all six sides of a book or box-like structure. The fastener is releasably snap-fitted into the base and secured therein by a pair of metal tines. The ratchet member includes a housing containing a gear and bearing member which are latched together in a spaced relationship to form a reel and a pawl. A bottom plate encloses the contents of the housing. The gear includes a multi-sided key hole, a plurality of openings to secure enlarged ends of the cables therein, and a plurality of teeth. The gear and bearing member each include an annular nub which sits in and rotates around a corresponding bearing surface of the bottom plate and housing, respectively. The pawl has a catch and a resilient spring and communicates with the gear to allow the ratchet member to be turned only in one direction. Two specialized tools are required to tighten the device around the box-like structure and to remove the security device from the same.

U.S. Pat. No. 7,162,899 by Fawcett et al. is for a "Cable Wrap Security Device." A security device includes a locking member, a ratchet mechanism, and a plurality of cables. The cables extend through both a fastener and a base of the locking member and are wrapped around all six sides of a box-like structure. The fastener is releasably snap-fitted into the base of the locking member and secured therein by a magnetically attractable tine. The ratchet mechanism includes a housing containing a spool and a locking pawl. A bottom wall encloses a portion of the housing and includes a rotatable central portion having a key receiving recess for unlocking the spool from the pawl. The housing has a rotatable top wall portion which includes a flip-up handle for rotating the top wall portion and the internal ratchet to tighten the cable about an article. An alarm system is contained in the housing of the ratchet mechanism and actuates an audible alarm upon certain unauthorized actions occurring. An LED located within the housing provides a visual indication that the alarm system is activated.

U.S. Pat. No. 7,685,850 by Nilsson is for a "Security Wrapper." A security device comprises a retaining member forming an adjustable loop, including a cable; a ratchet member connected to the cable, operable to narrow the loop and to prevent widening of the loop, including a first main part comprising a gear ring extending in a first plane with a saw tooth profile raised from the plane, a second main part, rotatable relative to the first main part, including a latch member biased towards the first plane to engage the gear ring, and a drum for winding up of the cable.

SUMMARY

An electronic article surveillance (EAS) security apparatus is comprised of a housing with electronics, a base plate, and ribbon pad and electrically conductive ribbons. The base plate affixes to one side of an object to be protected, and the ribbon pad attaches to another, most likely opposite, side of the object. The conductive ribbons are attached to the ribbon pad and wrap around the object and reach to the base plate. Retainers on the base plate hold the ribbons in place. The housing with electronics attaches to the base plate and makes electrical contact with the electrically conductive ribbons. This completes circuits enwrapping the object to be protected. The electronics in the housing then monitor the integrity of those circuits as well as other switches and sensors, etc.

The ribbon pad has a top surface and a bottom surface. The bottom surface may have adhesive on it for attachment to an object to be protected, such as a box. Electrically conductive ribbons are attached to the top surface of the ribbon pad. The conductive ribbons may be single continuous conductive segments attached to the ribbon pad at a central location on the conductive ribbon, or the conductive ribbons may be separate conductive segments connected at one of their ends to the ribbon pad with electrical continuity provided by elements on the ribbon pad. When more than one circuit is created by conductive ribbons, they are insulated from each other on the ribbon pad.

For some embodiments of the security apparatus, the ribbon pad may have a cover and when necessary, those ribbon pads have apertures in them to allow the passage of the conductive ribbon from the top surface of the ribbon pad to the exterior of the ribbon pad. For some of the embodiments of the ribbon pad with a cover, the cover will enclose a space over the top surface of the ribbon pad and, when the ribbon pad is initially produced, the bulk of the ribbon segments will be stored in this space with an end of the ribbon extending from the cover. The extended ends can be pulled to draw the ribbon segments out to length for installing the security apparatus.

The base plate has a top surface and a bottom surface and may have adhesive on the bottom surface to attach to an object to be protected, such as a box. The base plate is typically placed on a side opposite to that of the ribbon pad. The base plate has a retainer for each ribbon end to retain the ribbon end in place. The retainer may be an adhesive area, an area having snags, a spindle post, a clip, or other retainers. The base plate also has a first attaching component which is complementary to a second attaching component on the housing and which facilitates the attaching of the housing to the base plate.

The housing encloses an interior space in which are located electronic components. The housing has a top and bottom surface with electrical contacts on the bottom surface which have electrical continuity with the electronics within the housing. The electrical contacts are arranged such that they contact the electrically conductive ribbons when the housing is assembled to a base plate that has ribbons retained on them. Generally, the contacts will have locations mirroring those of the retainers on the base plate. The housing has a second attaching component which is complementary to a first attaching component on the base plate and which facilitates the attaching of the housing to the base plate. Along with the attaching components, the housing and base plate may have features that releasably lock them together once they are assembled to each other to prevent the unauthorized removal of the housing. The electronics housed in the interior space may include a passive EAS element, a power supply, a sound generator, a microprocessor, switches, light emitting diodes, and wireless communication elements, including infrared communication elements as well as radio frequency communication elements. Other electronic components may also be present.

Once the security apparatus is installed with the ends of the ribbons connecting between the contacts on housing, the electronics in the housing may alarm automatically or only enter a ready state. In the ready state, an external device can be used to arm the security apparatus. This may be accomplished with wireless communication or via contact between the security apparatus and the external device. An external device is used to disarm the electronics when an authorized person wishes to remove the security apparatus from an object being protected.

Disarming of the security apparatus may be accomplished by authorized personnel. An authorized person having access to other elements of the EAS system such as a hand held communication device or a base station having communication capabilities may disarm the device. Some embodiments will add another element of security with passcode capabilities in the respective electronics. The security apparatus electronics of these embodiments are capable of storing a passcode which is known to the communication elements of the EAS system and which can be used to confirm to the security apparatus that the disarming signal is authorized. A further element of security can be added by using clock based algorithms to change the passcode synchronously. In those embodiments, the EAS system and the EAS security apparatus both have clock generators and are programmed with the same algorithm and both are programmed with the same initial passcode. As time passes, the algorithm alters the passcode at preset intervals as regulated by the clock generators. This changing passcode further complicates unauthorized attempts to disarm the security apparatus. If a security apparatus tag is detached without being disarmed with the appropriate passcode, the security apparatus will determine an alarm condition exists and generate an alarm.

BRIEF DESCRIPTIONS OF THE DRAWINGS

DESCRIPTION OF THE EMBODIMENTS

Figure 2:
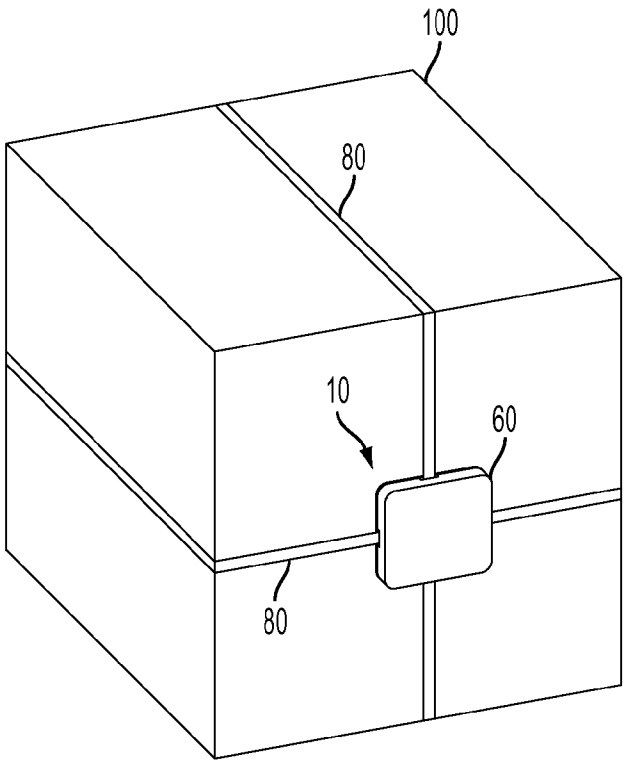
FIG. 2 is a rear perspective view of an object being protected with an embodiment of the security apparatus attached.
Figure 1:
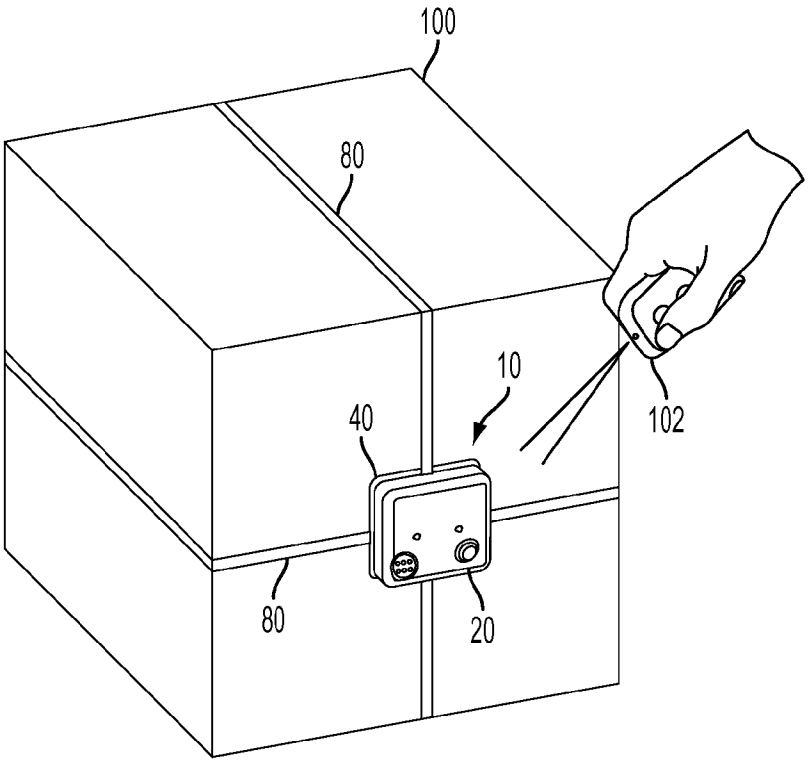
FIG. 1 is a front perspective view of an object being protected with an embodiment of the security apparatus attached.

FIG. 1 is a front perspective view of an object 100 being protected by an attached embodiment of security apparatus 10. In the embodiment shown in FIG. 1, base plate 40 is attached to object 100 and housing 20 is attached to base plate 40 with ribbons 80 retained between them. Ribbons 80 pass around object 100 and intersect on the opposite side. FIG. 2 is a rear perspective view of object 100 which shows that opposite side with ribbon pad 60 installed on it, and ribbons 80 intersecting on ribbon pad 60. Ribbons 80 are electrically conductive along their lengths and, depending on their embodiment, may be electrically conductive at their surfaces or may have electrically conductive elements not exposed at their surfaces.

Figure 4:
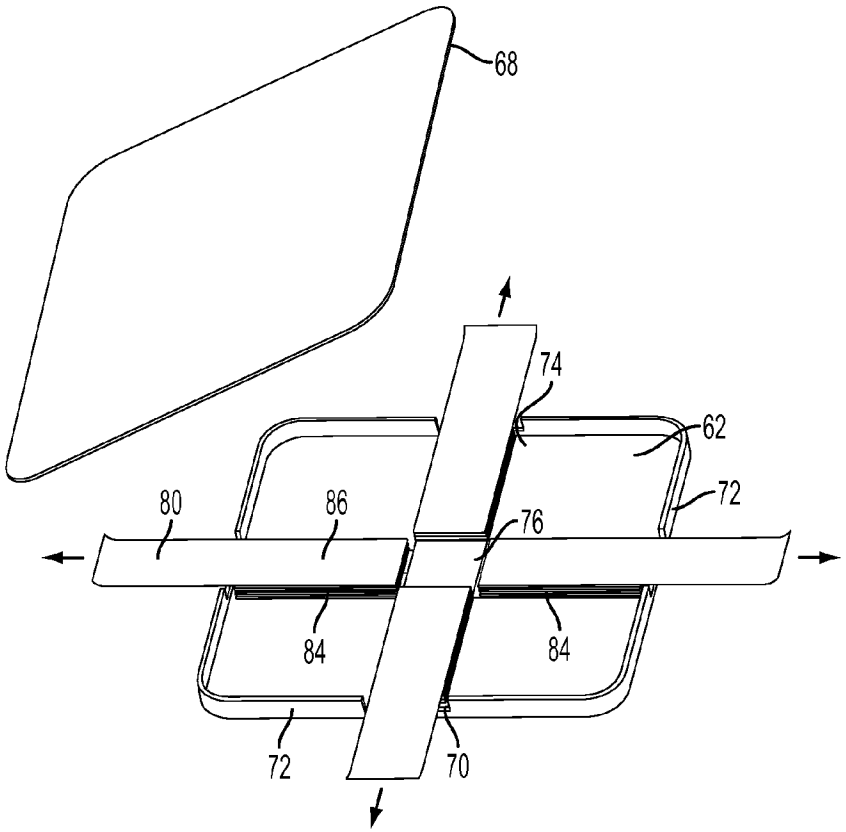
FIG. 4 is a perspective view of the ribbon pad of FIG. 3 with the cover lifted.
Figure 3:
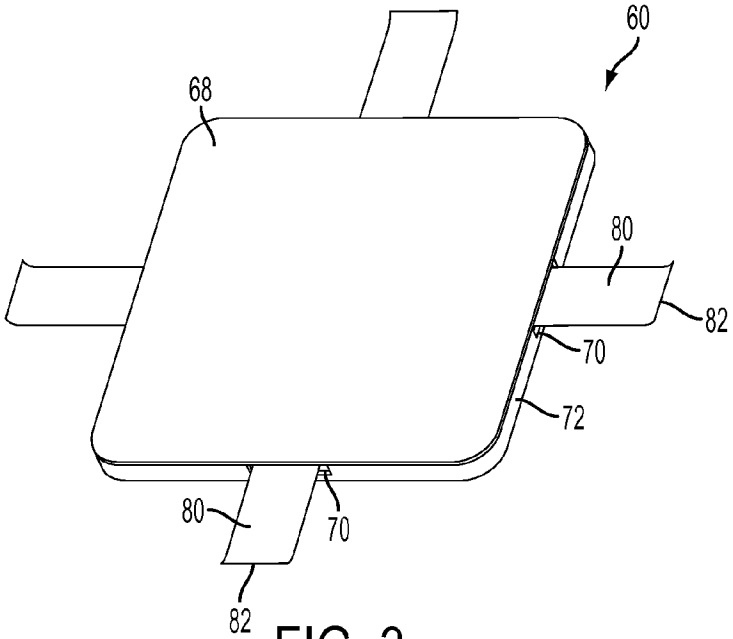
FIG. 3 is a top perspective view of a ribbon pad with a cover.

FIG. 3 is a top perspective view of ribbon pad 60 with a cover 68. Extending ends 82 of ribbons 80 extend out of ribbon apertures 70 in ribbon pad 60. In the embodiment of ribbon pad 60 shown in FIG. 3, ribbon apertures 70 penetrate sides 72 of ribbon pad 60. FIG. 4 is a perspective view of the embodiment of ribbon pad 60 of FIG. 3 with cover 68 lifted, exposing interior space 74 of ribbon pad 60 and showing top surface 62. Ribbons 80 reach to central hub 76 and are shown in FIG. 4 before deployment with the bulk of their lengths taken up in stacks 84. When security apparatus 10 is installed on an object to be protected, extending ends 82 of ribbons 80 are pulled to extract ribbons 80 and extend them out to their full lengths. Different ribbon pads 60 may have different standard lengths for ribbons 80. For smaller objects, ribbon pads 60 with shorter standard lengths for ribbons 80 can be used, while ribbon pads 60 will longer ribbons 80 can be selected for larger objects.

Ribbon segments 86 of ribbons 80 may be opposing ends of a single continuous ribbon that passes through central hub 76 of ribbon pad 60 or they may be separate segments which terminate at central hub 76 and have electrical continuity created between pairs of ribbon segments 86 by ribbon pad 60. Embodiments of ribbon pad 60 may have ribbon segments 86 on opposite sides of ribbon pad 60 in electrical continuity with each other, or ribbon segments 86 on neighboring sides of ribbon pad 60 may have electrical continuity with each other. Additionally, in some embodiments of security apparatus 10, each ribbon segment 86 will be separate and have electrical continuity with each of the other ribbon segments 86 provided by ribbon pad 60.

Figure 5:
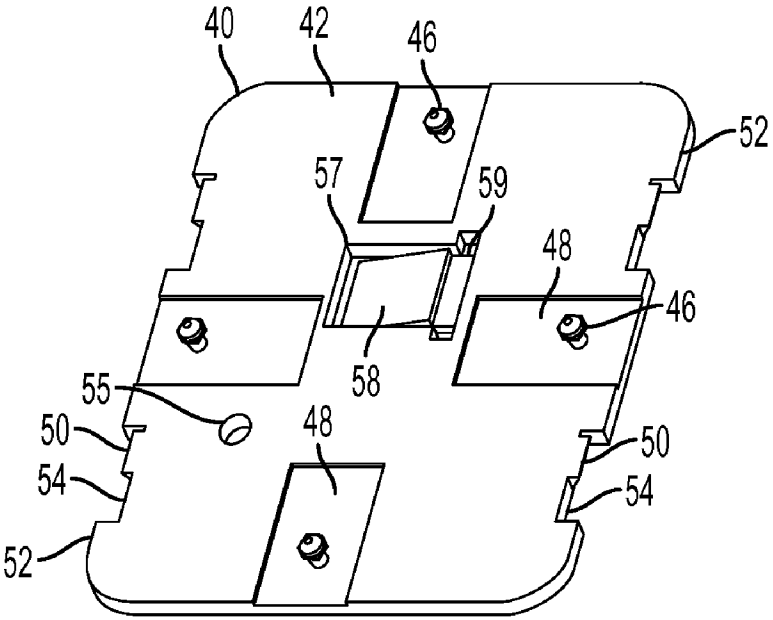
FIG. 5 is a top perspective view of a base plate.

FIG. 5 is a top perspective view of base plate 40. Base plate 40 has several target areas 48 and retainers 46 on top surface 42. Target areas 48 provide a guide to where extending ends 82 of ribbons 80 will be when security apparatus 10 is installed on an object to be protected. In the embodiment shown in FIG. 5, retainers 46 are spindle studs. Extending ends 82 of ribbons 80 are forced over retainers 46 and extending ends 82 of ribbons 80 are held in place on base plate 40 (see also FIG. 9).

In addition to features relating to ribbons 80, base plate 40 has features relating to attaching a housing 20 to base plate 40. Tabs 50 on two opposing edges 52 of base plate 40 act as the first attaching element in a system for attaching housing 20 to base plate 40. Hooks 23 on the bottom 22 of housing 20 act as the second attaching element in a system for attaching housing 20 to base plate 40 (See FIG. 10). Hooks 23 on housing 20 are constructed and located to engage tabs 50. In the embodiment shown in FIG. 5, notches 54 in opposing edges 52 of base plate 40 allow hooks 23 to pass through top surface 42 of base plate 40 next to tabs 50. Housing 20 is slid to engage hooks 23 to tabs 50 of base plate 40. Once housing 20 is attached to base plate 40, security apparatus 10 has a locking mechanism for preventing the removal of housing 20 from base plate 40. Base plate 40 has retention aperture 55 which receives a biased retention pin when housing 20 is attached to base plate 40.

Figure 6:
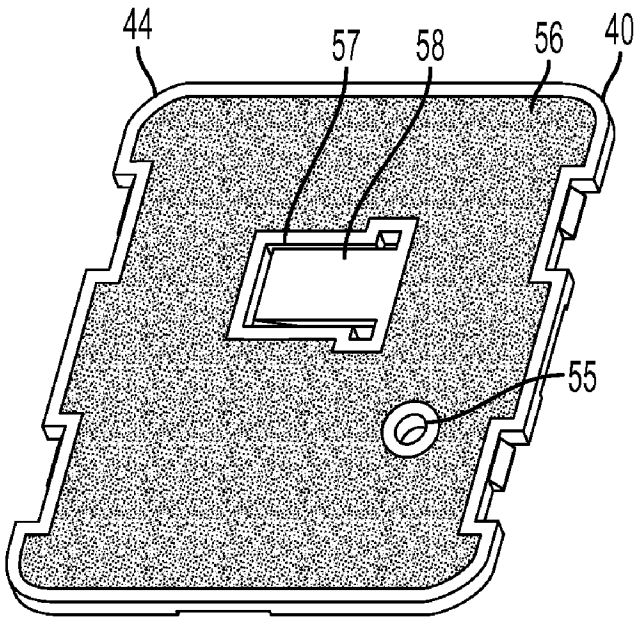
FIG. 6 is a bottom perspective view of the base plate of FIG. 5.

FIG. 6 is a bottom perspective view of base plate 40 of FIG. 5. Bottom surface 44 of base plate 40 has an adhesive element 56 on it which facilitates the mounting of base plate 40 on an object to be protected. Adhesive element 56 may be an adhesive pad or adhesive element 56 may be a layer of adhesive applied directly to bottom surface 44 of base plate 40. Adhesive element 56 may be applied to base plate 40 when it is produced by a manufacturer, or adhesive element 56 may be applied to base plate 40 before it is used by an end user. Retention aperture 55 is also visible in the bottom perspective view of base plate 40.

Referring now to FIGS. 5 and 6, switch aperture 57 is located generally centrally in base plate 40 and at least partially covered by switch plate 58. Switch plate 58 pivots at hinge 59. Switch aperture 57 and switch plate 58 in base plate 40 are located to align with a plunger switch on the bottom of housing 20. When base plate 40 is not setting on an object, switch plate 58 hangs low, but when base plate 40 is setting on an object, the surface of the object pushes switch plate 58 to a higher position. In this higher position, switch plate 58 affects a switch on the bottom of housing 20. The interaction between switch plate 58 with housing 20 will be described further below.

Figure 8:
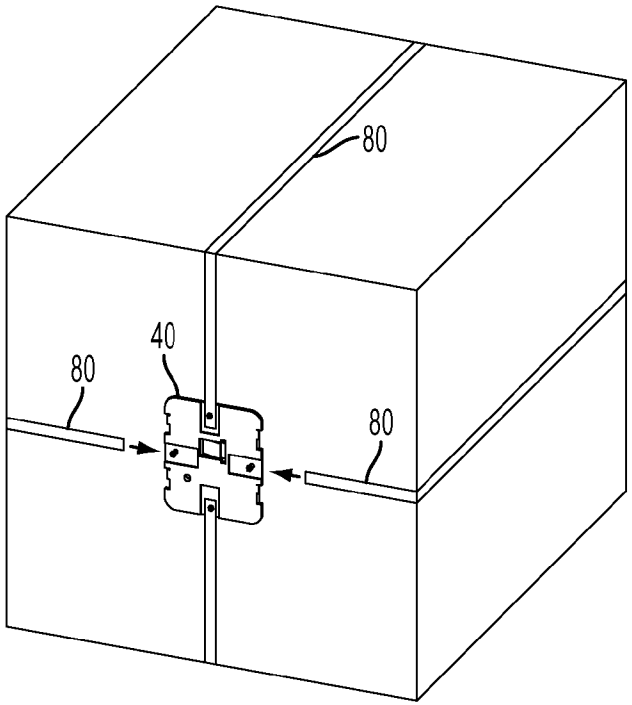
FIG. 8 is a front perspective view of an object to be protected with a base plate installed and partially connected by ribbons to an associated ribbon pad.
Figure 7:
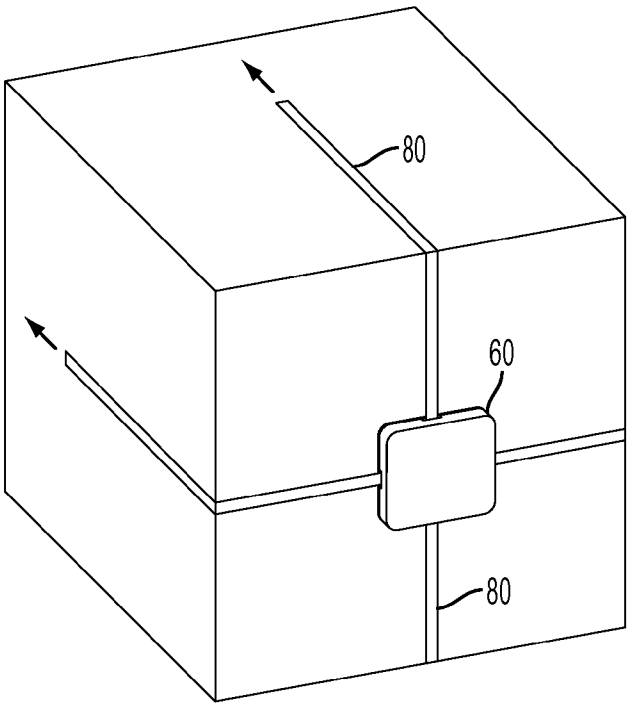
FIG. 7 is a rear perspective view of an object to be protected with a ribbon pad installed and ribbons in the process of being deployed.
Figure 9:
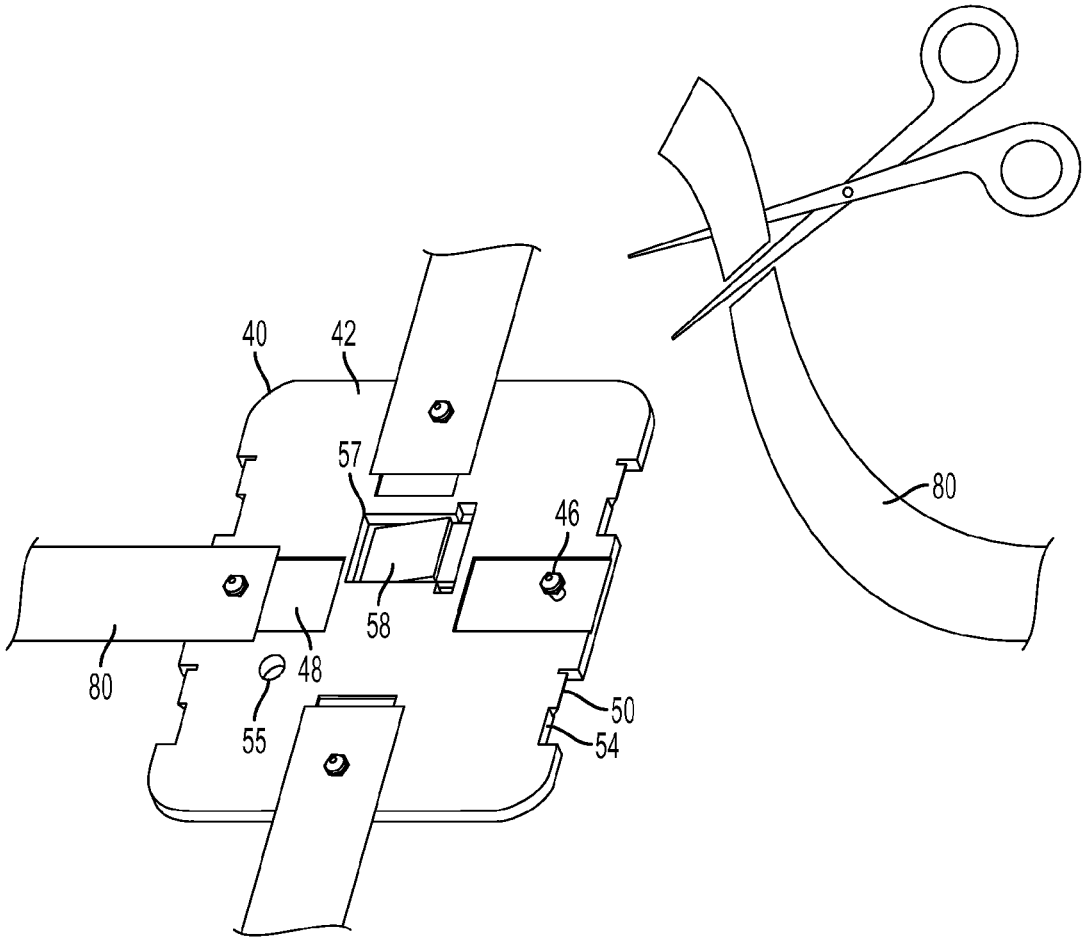
FIG. 9 is a perspective view showing excess ribbon being trimmed to install the security apparatus on an object to be protected.

FIG. 7 is a rear perspective view of an object to be protected 100 with a ribbon pad 60 installed on one side and ribbons 80 in the process of being deployed. FIG. 8 is a front perspective view of an object to be protected 100 with a base plate 40 installed on a side opposite to that of ribbon pad 60 and partially connected by ribbons 80 to the associated ribbon pad 60. An initial step in installing security apparatus 10 is the installation of a ribbon pad 60 on an object to be protected. Ribbons 80 may then be drawn to length from ribbon pad 60 to be in position when base plate 40 is installed, or base plate 40 may be installed prior to the extension of ribbons 80. Extending ends 82 of ribbons 80 are held in place on base plate 40 by retainers 46. FIG. 9 is a perspective view of a partially installed base plate 40 showing a ribbon 80 being trimmed to length for installation of security apparatus 10. Different ribbon pads 60 may be manufactured with different standard lengths for ribbons 80, for tighter deployment of ribbons 80, excess length can be trimmed. This also prevents ribbons 80 from contacting each other between housing 20 and base plate 40, so that electrical circuits are only completed through housing 20. In FIGS. 8 and 9, retainers 46 are spindle studs, and extending ends 82 of ribbons are pressed down on retainers 46 and pierced to be held in place.

Figure 10:
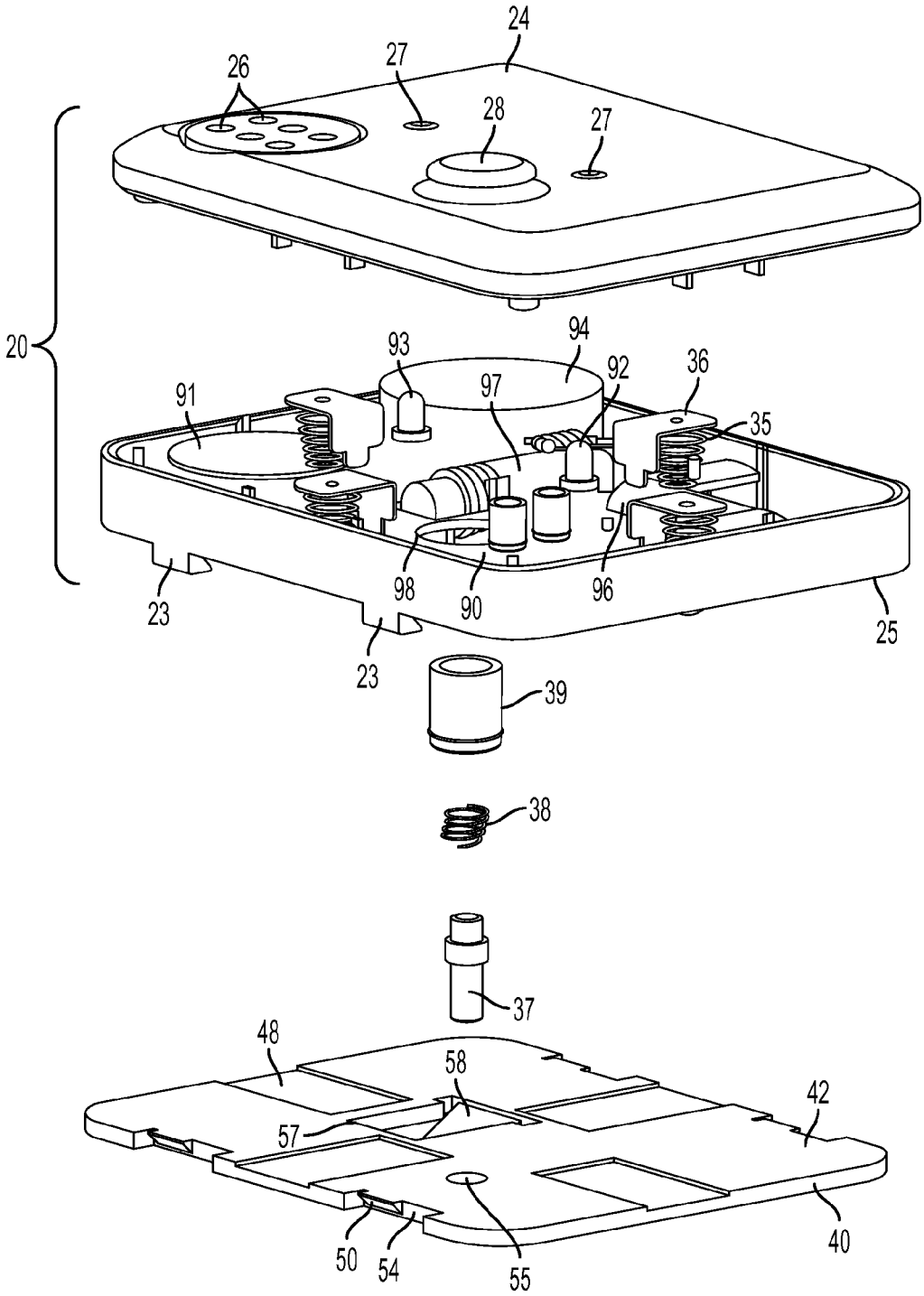
FIG. 10 is an exploded perspective view of embodiments of a housing and base plate.

FIG. 10 is an exploded perspective view of embodiments of a housing 20 and base plate 40. Housing 20 is separated into top portion 24 and bottom portion 25 and elements contained in the interior of housing 20 are visible. Circuit board 90 provides a framework for mounting the several electronic components in the interior of housing 20. The electronic elements may include sound generator 91, light emitting diode (LED) 92, wireless communication elements such as optical communication port 93, microprocessor 94, plunger switch 95 (not shown in FIG. 10), power supply 96, and passive EAS element 97.

Circuit board 90 has clearance aperture 98 in it to allow the presence and operation of blocking pin 37. Blocking pin 37 acts in conjunction with retention aperture 55 in base plate 40 to provide a locking mechanism between housing 20 and base plate 40. Spring 38 biases blocking pin 37 to extend from bottom surface 22 of housing 20 and cup 39 maintains them in position. When housing 20 and base 40 are first put together, blocking pin 37 is compressed up into housing 20. When housing 20 and base 40 are moved to engage hooks 23 with tabs 50, blocking pin 37 and retention aperture 55 align, and blocking pin 37 extends into retention aperture 55. Blocking pin 37 comprises a magnetically attractable material and can be retracted by application of a magnetic force to housing 20. When base 40 is assembled onto an item to be protected, retention aperture 55 is not accessible, and, therefore, blocking pin 37 is not accessible.

Top portion 24 has several features to facilitate the operation of security apparatus 10. When housing 20 is assembled, sound generator 91 aligns with auditory apertures 26 while LED 92 and optical communication port 93 align with optical apertures 27. Sound apertures 26 allow better external transmission of sounds generated by sound generator 91. Optical apertures 27 allow transmission and reception of optical signals by LED 92 and optical communication port 93. Dome 28 provides a clear target for application of a magnet to detach housing 20 from base 40. Application of a magnet to dome 28 shifts pin 37 upward and withdraws it from retention aperture 55. This allows housing 20 to slide with respect to base 40 to disengage hooks 23 from tabs 50. Housing 20 may then be lifted from base 40. As will be described later, removal of housing 20 from base 40 without properly disarming security apparatus 10 will cause the electronics in housing 20 to determine that an alarm condition exists.

Figure 11:
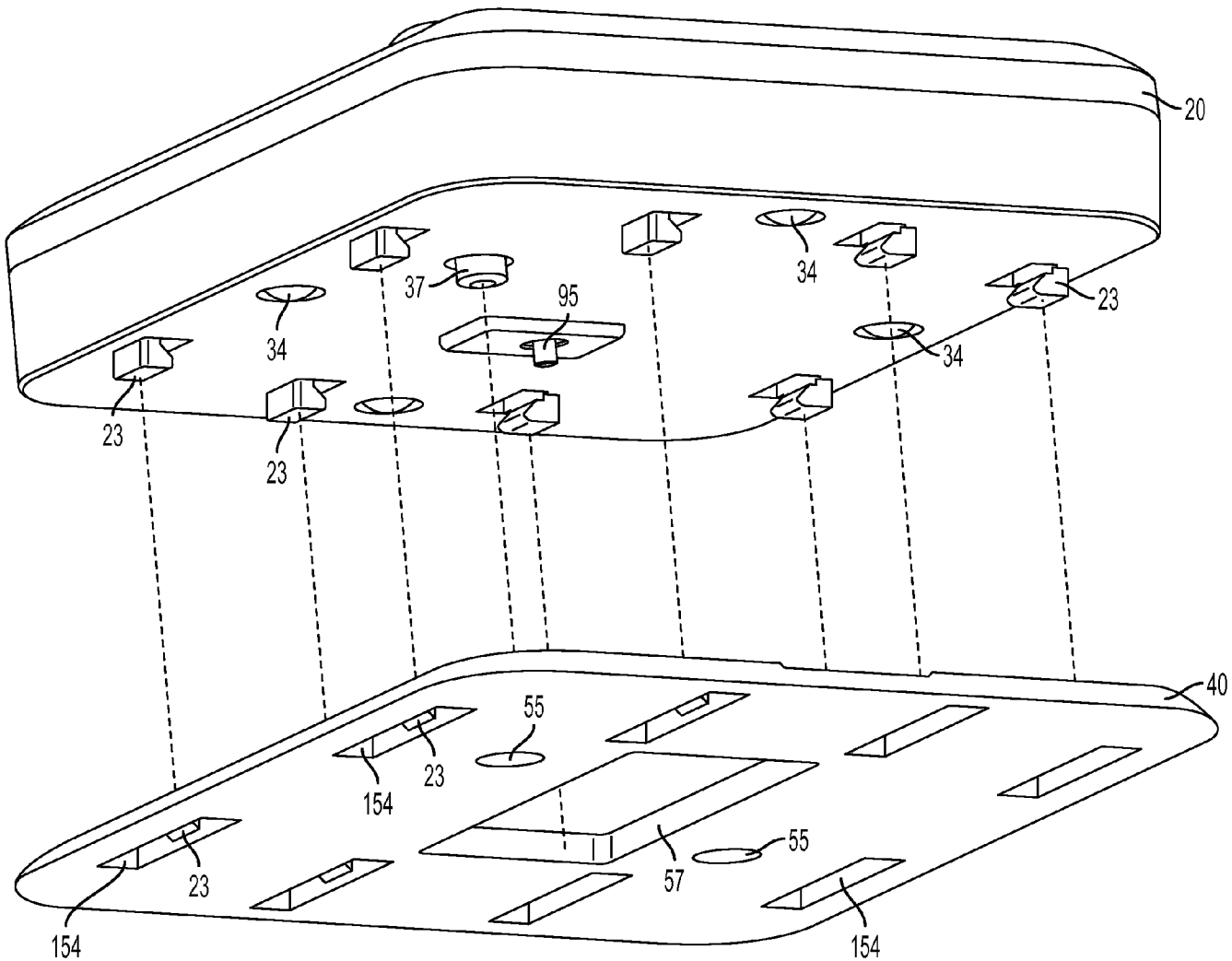
FIG. 11 is a bottom perspective view of a housing over a base plate.

FIG. 11 is a bottom perspective view of an embodiment of housing 20 over a base plate 40. These embodiments are similar to the previously discussed embodiments but have some differences as well. The attaching components, tabs 50, are located in the interior area of base 40 with slots 154 providing sliding access to tabs 50 for hooks 24 depending from bottom surface 22 of housing 20. Blocking pin 37 extends from bottom surface 22 of housing 20 and will engage either of retention apertures 55 in base 40 depending upon the orientation of housing 20 on base 40 when they are attached to each other. Plunger switch 95 extends from bottom surface 22 of housing 20 and aligns generally with switch aperture 57 centrally located in base plate 40. In the embodiment of base plate 40 shown in FIG. 11, switch aperture 57 is not covered by a switch plate. Electrical contacts 34 are located in bottom surface 22 of housing 20 in suitable locations to make contact with ribbons 80 when security apparatus 10 is installed on an object to be protected.

Figure 12:
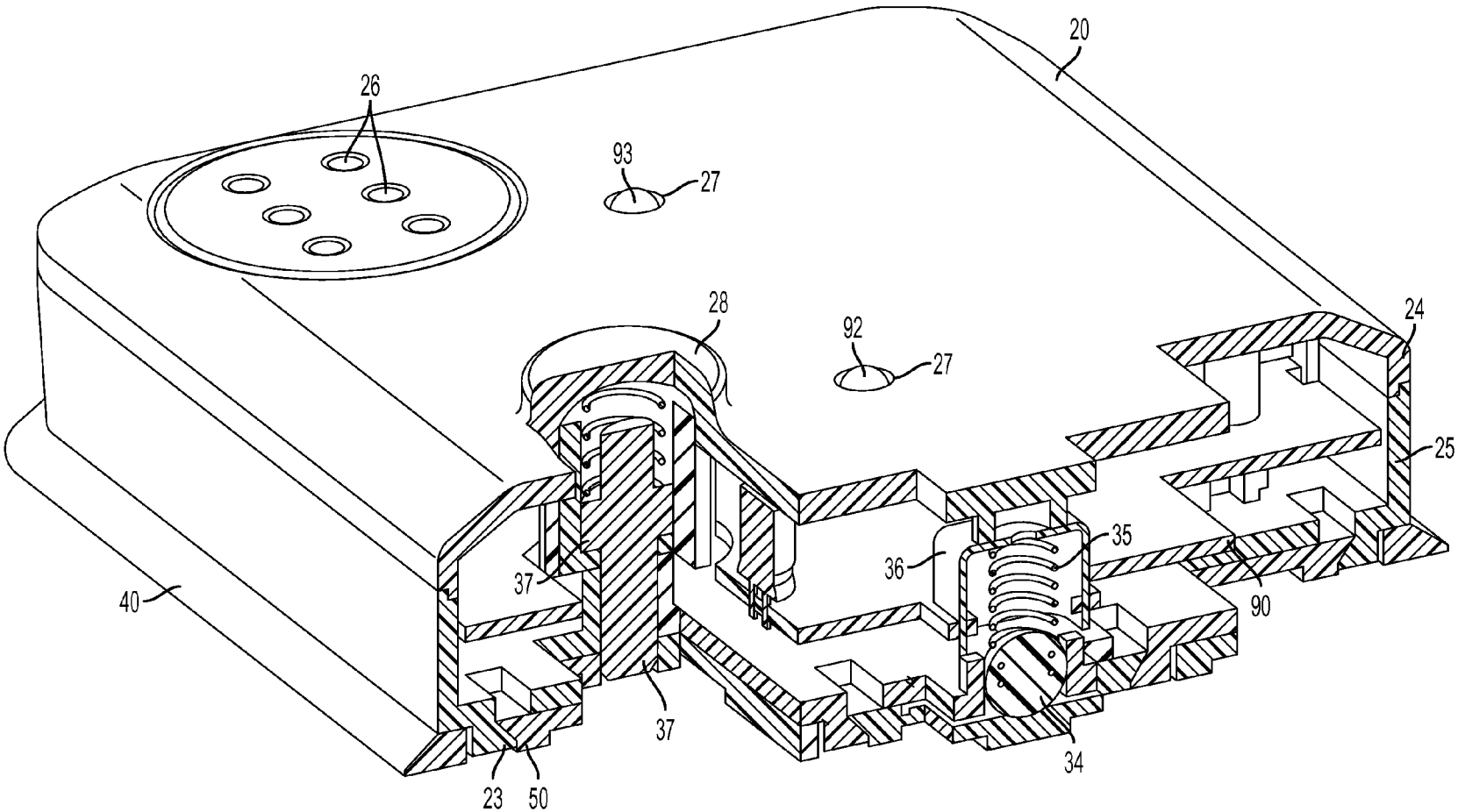
FIG. 12 is a sectioned perspective view of a housing attached to a base plate.

FIG. 12 is a sectioned perspective view of housing 20 attached to base plate 40. In particular, FIG. 12 offers sectioned views of the position and operation of blocking pin 37 and electrical contacts 34. Referring to FIG. 12, blocking pin 37 may be seen beneath dome 28 of housing 20 and engaged in retention aperture 55 in base 40. Spherical electrical contact 34 is biased by spring 35 down onto base 40 where a conductive ribbon 80 would be positioned. Connector 36 completes the electrical connection to circuit board 90. Reference may also be made to FIG. 10 where springs 35 and connectors 36 may be seen. Additionally, in FIG. 12, in several places a hook 23 may be seen engaging a tab 50 in a slot 154.

Figure 13:
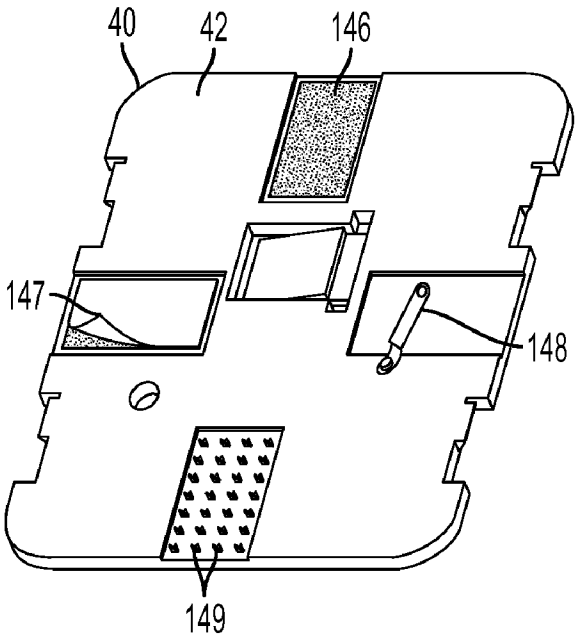
FIG. 13 is perspective view of a base plate showing several possible types of ribbon retainers.

FIG. 13 is perspective view of a base plate 40 showing additional possible types of ribbon retainers 46. Retainer 146 at the top target area 48 and top left target area of base plate 40 is an adhesive patch. At the top left position cover 147 is shown partially removed from retainer 46. At the right target area 48 in FIG. 13, retainer 46 is a clip 148. At the bottom target area 48 in FIG. 13, retainer 46 is a field of snags 149, or sharp raised elements. Each of these types of retainers as well as others could be used to hold ribbons 80 in place when security apparatus 10 is installed.

Figure 14:
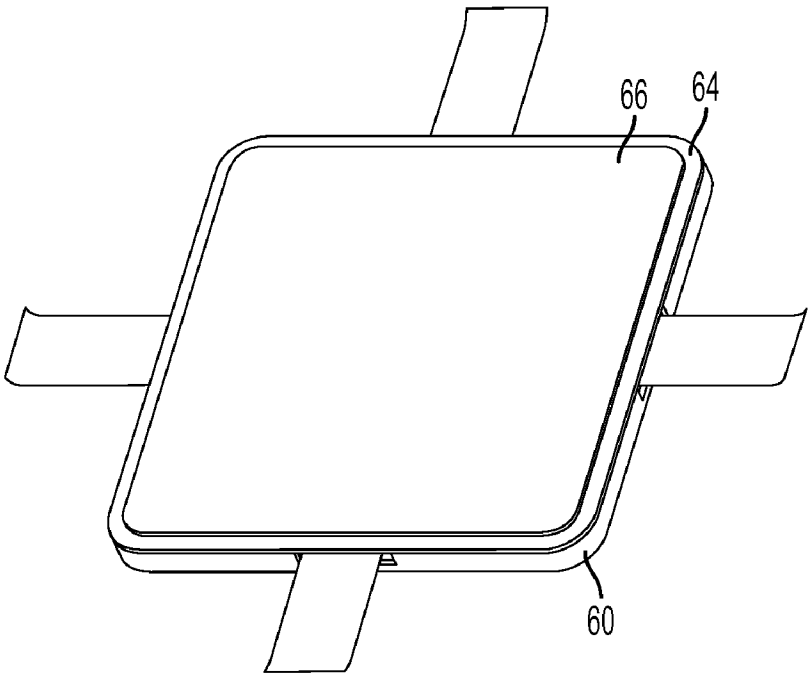
FIG. 14 is rear perspective view of an embodiment of a ribbon pad showing adhesive on the bottom surface of the ribbon pad.
Figure 15:
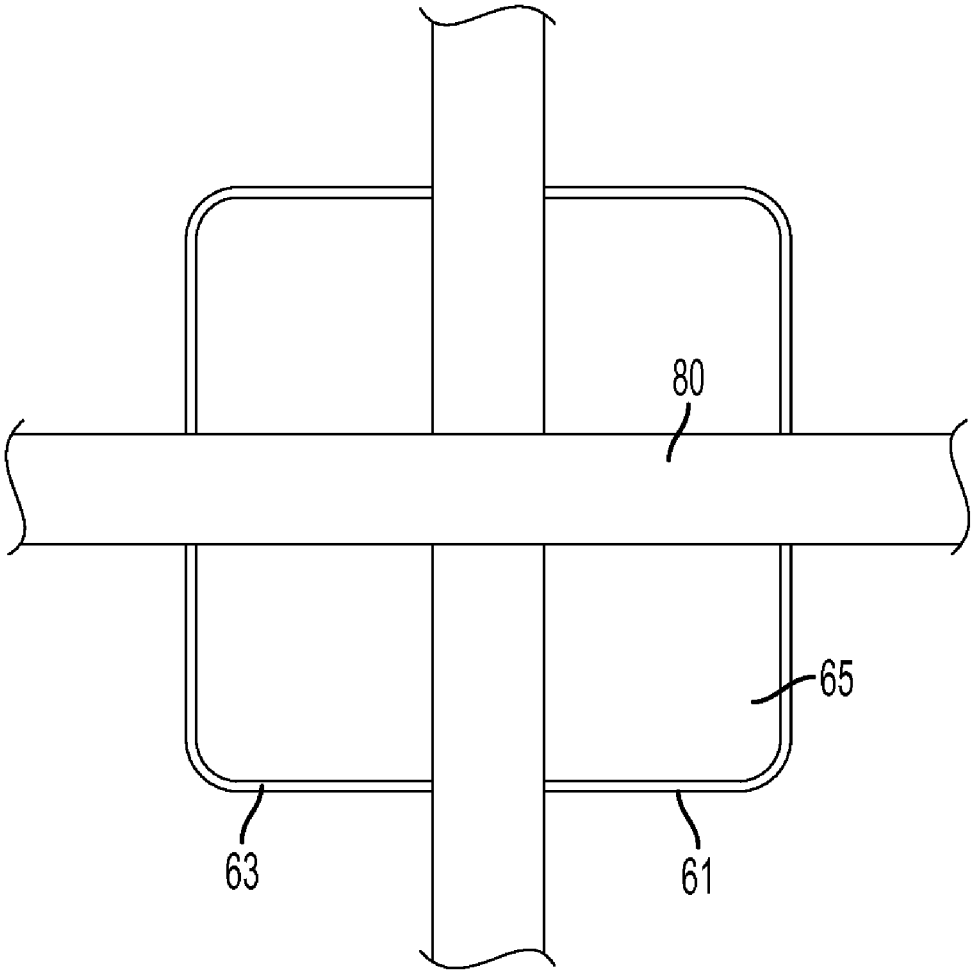
FIG. 15 is perspective view of an embodiment of a ribbon pad with ribbons crossing on a surface of the ribbon pad and held in place by adhesive.

FIG. 14 is rear perspective view of ribbon pad 60. FIG. 14 shows adhesive 66 on the bottom surface 64 of the ribbon pad 60. FIG. 15 is a perspective view of an embodiment of a ribbon pad 61 with ribbons 80 crossing on a surface 63 of ribbon pad 60 and held in place by adhesive 65. Surface 63 may be either the top or bottom surface of ribbon pad 61 and ribbon pad 61 may be a simple adhesive pad such as pressure sensitive adhesive pad.

In the following paragraphs one method to install security apparatus 10 on an object to be protected 100 will be described. The order of steps described below is described only for the purpose of explanation and should not be construed as the only order of installation. A different order of steps could quite easily be used.

Referring to FIGS. 3 and 4, base plate 40 is installed on a surface of an object to be protected. Adhesive on the bottom surface of base plate 40 may be used to fix base plate 40 in place. Ribbon pad 60 is installed on another surface of the object to be protected, most usually a surface essentially opposite to that on which base plate 40 is installed. Ribbons 80 are pulled and extended from ribbon pad 60 and passed around the object to be protected toward base plate 40. If ribbons 80 are excessive in length, they may be trimmed to the appropriate length. The extended ends 82 of ribbons 80 are placed on base plate 40 and retained on base plate 40 by retainers 46. Ribbons 80 are electrically conductive. Retainers 46 may take several forms and in some embodiments of security apparatus 10 may need only to maintain ribbons 80 in place long enough to install housing 40.

Once base plate 40 and ribbon pad 60 are installed with ribbons 80 installed between them, housing 20 is attached to base plate 40. Referring now to FIGS. 10-12, base 40 has a first attaching element, which in the embodiments of FIGS. 10-12 are tabs 50. Housing 20 has a second attaching element, which in the embodiments of FIGS. 10-12 are hooks 23. In the embodiment of FIG. 10, tabs 50 are located at edges 52 of base 40 and the respective hooks 23 on housing 20 have access to tabs 50 via notches 54. In the embodiment of FIGS. 11 and 12, hooks 23 have access to tabs 50 via slots 154 in the base. To attach housing 20 to base 40, housing 20 is set on base 40 with hooks 23 in their respective access sites and housing 20 is slid with respect to base 40 to engage hooks 23 with tabs 50. For the purposes of explanation, specific embodiments housing 20 and base 40 are shown and discussed regarding how they may be attached to each. However, there are many arrangements and methods where complementary attaching elements on housing 20 and base 40 may be used to attach housing 20 to base 40.

Once housing 20 is attached to base 40, security apparatus 10 may have additional elements to prevent the unauthorized removal, or accidental separation, of housing 20 from base 40. In FIG. 11, blocking pin 37 and retention aperture 55 combine to act as a locking mechanism. Blocking pin 37 extends from bottom surface 22 of housing 20. Matching retention apertures 55 in base 40 are positioned to align with blocking pin 37. Blocking pin 37 is biased to extend from housing 20 by spring 38. Blocking pin 37, spring 38, and cup 39, which maintain pin 37 and spring 38 in position, may be seen in exploded view in FIG. 10 and in section view in FIG. 12. When housing 20 is placed on base 40, blocking pin 37 is compressed up into housing 20. When housing 20 is slid to engage hooks 23 with tabs 50, blocking pin 37 aligns with retention aperture 55 and extends into retention aperture 55. This locks housing 20 in place, preventing housing 20 from sliding with respect to base 40, and housing 20 cannot be detached from base 40 without pin 37 being withdrawn. In FIG. 12, pin 37 is engaged in retention aperture 55.

In the embodiments shown in FIGS. 10-12, blocking pin 37 is at least partially comprised of magnetically attractable material to facilitate the withdrawal of pin 37 from aperture 55. To withdraw pin 37 from aperture 55, a magnet is applied to housing 20 in proximity to pin 37. Dome 28 on top of housing 20 provides a visual cue for where best to place a magnet to withdraw pin 37 from aperture 55.

In FIG. 11, contacts 34 on bottom surface 22 of housing 20 are in electrical continuity with the electronics within housing 40 and are arranged to align with target areas 48 on base plate 40 (see FIGS. 5, 9, and 10), when housing 20 is attached to base plate 40. More specifically, contacts 34 are arranged to make electrical contact with ribbons 80 retained on base plate 40. When electrical contacts 34 complete electrical contact with ribbons 80, the electronics within housing 40 detect at least one completed circuit through ribbons 80. If multiple sets of ribbon segments 86 extend from ribbon pad 60, and the multiple sets are insulated from each other within ribbon pad 60, multiple completed circuits will be detected by the electronics within housing 20.

Once the completed electrical circuits are detected by the electronics within housing 20, they may automatically arm themselves. Alternatively, once the condition of completed circuits is achieved, the electronics may shift to a ready state, and await arming by an external device, such as a remote hand held device like remote 102 shown in FIG. 1. This arming by remote 102 may occur by wireless communication such as by optical communication or radio frequency communication. Alternatively, remote 102 may be placed in contact with security apparatus 10 for direct communication. Once the electronics within housing 20 are armed, they monitor ribbons 80 for tampering. The electronics monitor ribbons 80 for open circuit conditions as well as changes in resistance. To monitor for changes in resistance, the electronics establish a baseline measurement resistance through ribbons 80 at the time of arming. An open circuit indicates that a ribbon 80 has been cut or removed from base 40, while a change in resistance may signal that a ribbon has been stretched or that a jumper has been applied to a ribbon 80 before cutting it. Regardless of whether security apparatus 10 is armed with a remote device rather than arming automatically, it needs to be disarmed to remove security apparatus 10 from an object 100 without the electronics determining an alarm condition. If the electronics determine an alarm condition, sound generator 91 can generate an audible alarm, while the wireless communication elements in the electronics can communicate with external monitoring devices in an area wide monitoring system. When housing 20 also encloses a passive EAS element 97, if the object being protected is taken through an interrogation field, the system generating the interrogation field will detect the passage of the object and raise an alarm.

In some embodiments of security apparatus 10, the electronics within housing 20 may monitor additional signals for arming status and tampering. In FIG. 11, switch 95 extends from bottom surface 22 of housing 20. Switch 95 generally aligns with switch aperture 57 in base 40. Switch 95 is in electrical continuity with the other electronics within housing 20. In the embodiment shown in FIG. 11, when base 40 is on a surface and housing 20 is attached to base 40, switch 95 has its state changed and this state change is registered in the electronics of housing 20 such as in microprocessor 94. This change in state for switch 95 is interpreted as indication that housing 20 has been attached to plate 40 which is installed on an object, and the electronics may automatically arm at that time or switch to a standby mode to await arming by an external action. In this embodiment, once security apparatus 10 is armed, a change in state of switch 95 is interpreted by the electronics as an alarm condition and the electronics will react.

Other embodiments of security apparatus 10 may use a switch plate 58 in base plate 40 (See FIGS. 5, 6, 9, 10, and 13). When base plate 40 is not on an object, switch plate 58 hangs freely, but when base plate 40 is on an object, switch plate 58 is forced up into switch aperture 57 in base plate 40. In these embodiments, when housing 20 is attached to base plate 40, it is switch plate 58 that switch 95 contacts to have its state changed. If the assembly of housing 20 and base 40 are removed from an object, switch plate 58 can move partially from switch aperture 57 and allow switch 95 to move and change its state. This change in state for switch 95 will register with electronics in housing 20. If security apparatus 10 has not been disarmed, the electronics will interpret this change in state as an alarm condition.

The embodiments of ribbon pad 60 shown in FIGS. 3, 4 and 14 carry on them ribbon segments 86 for installation. These ribbon segments may be different ends of single continuous lengths of ribbons or they may be separate segments connected by ribbon pad 60. At least one alternative embodiment of security apparatus 10 has segments of ribbon 80 initially separate from ribbon pad 61 (See FIG. 15), which has adhesive 65 on at least one of its top or bottom surfaces 63. In these embodiments, base plate 40 is installed on an object and ribbons 80 are cut to length for the object. Ribbons 80 may then be installed before ribbon pad 60 or after ribbon pad 60. In the former case ribbon pad 60 is placed over the intersection of ribbons 80 to stabilize them in place. In the latter case, ribbon pad 60 is installed with adhesive on its top surface and ribbons 80 are placed on ribbon pad 60 as they are installed and attached to base plate 40. If necessary to insulate separate ribbons 80 from each other, a suitable insulator can be placed between ribbons 80 in either case.

FIG. 1 shows a hand held remote 102 communicating with security apparatus 10. The assembly of security apparatus 10 to an object establishes the conditions for activating security apparatus 10. Hand held remote 102 may communicate with security apparatus 100 with any of several known methods. These methods may include infrared communication and radio frequency communication as well as other known communication methods. Handheld remote 102 may also be used to deactivate security apparatus 10 to allow security apparatus 10 to be removed without causing an alarm. The electronics of some embodiments of security apparatus 10 may have passcode protection. These embodiments are capable of storing a passcode which is required to be matched by the external device such as handheld remote 102 for the communication from the external device to be ascertained as authorized. For further protection the electronics of some embodiments of security apparatus 10 may include a clock generator and the electronics may have machine readable instructions with an algorithm to change the passcode at preprogrammed time intervals. The EAS system, including handheld remote 102, also has at least one clock generator and is capable of updating the passcode at the preset intervals to update the systems record of the passcode. This keeps the passcode between security apparatus 10 and the rest of the EAS system synchronized.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciated that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. A security apparatus comprising:

a ribbon pad having a bottom surface and a top surface and at least one set of at least two electrically conductive ribbon segments extending from said top surface of said ribbon pad, each of said electrically conductive ribbon segments within each set having electrical continuity with each other;

a base plate having a bottom surface, a top surface, a first attaching component, and a retainer for the end of each said ribbon segment opposite said ribbon plate; and, a housing enclosing an interior space and housing electronic components, said housing having a bottom surface, a top surface and at least one side connecting said bottom surface and said top surface, said housing having a second attaching component complimentary to said first attaching component on said base plate, said first attaching component and said second attaching component facilitating the releasable attachment of said housing to said base plate with said bottom surface of said housing facing said top surface of said base plate;

said bottom surface of said housing having at least one set of two electrical contacts, each said electrical contact having electrical continuity with the interior of said housing and positioned to make contact with an electrically conductive ribbon segment retained on said base plate, said electronic components in said housing completing electrical continuity within each set of electrical contacts;

wherein said electrically conductive ribbon segments are sufficiently long to wrap around an object to be protected and contact a base plate positioned on the object opposite to a ribbon pad.

2. The security apparatus of claim 1, wherein:

said bottom surface of said ribbon pad has adhesive on it.

3. The security apparatus of claim 1, wherein:

said ribbon pad further comprises a cover over said top surface of said ribbon pad.

4. The security apparatus of claim 3, further comprising:

an aperture in said ribbon pad for each said ribbon segment extending from said top surface of said ribbon pad.

5. The security apparatus of claim 1, wherein:

said ribbon pad has at least two sets of two electrically conductive ribbon segments extending from said top surface of said ribbon pad, said two electrically conductive ribbon segments of each set having electrical continuity with each other.

6. The security apparatus of claim 1, wherein:

said ribbon pad comprises an adhesive pad having a top surface and a bottom surface and adhesive on at least one of said surfaces.

7. The security apparatus of claim 1, wherein:

said at least two electrically conductive ribbon segments of said at least one set are opposing ends of a single continuous electrically conductive ribbon.

8. The security apparatus of claim 1, wherein:

said bottom surface of said base plate has adhesive on it.

9. The security apparatus of claim 1, wherein:

said retainer for the end of each said ribbon segment opposite said ribbon plate comprises a spindle post.

10. The security apparatus of claim 1, wherein:

said retainer for the end of each said ribbon segment opposite said ribbon plate comprises adhesive.

11. The security apparatus of claim 1, wherein:

said retainer for the end of each said ribbon segment opposite said ribbon plate comprises a clip.

12. The security apparatus of claim 1, wherein:

each of said electrically conductive ribbon segments is electrically conductive at its surface.

13. The security apparatus of claim 1, further comprising:

a releasable locking mechanism preventing the removal of said housing from said base plate.

14. The security apparatus of claim 13, said locking mechanism comprising:

a spring biased pin located in said housing and protruding from said bottom surface of said housing, said pin being at least partially comprised of a magnetically attractable material.

* * * * *